United States Patent [19]

Bonomi

[11] Patent Number: 4,596,188

[45] Date of Patent: Jun. 24, 1986

[54] METHOD OF FIXING AND ADJUSTING A PRINTING PLATE ON A PLATE CYLINDER AND DEVICE FOR CARRYING OUT THE METHOD

[75] Inventor: Antonio Bonomi, Lausanne, Switzerland

[73] Assignee: De La Rue Giori S.A., Switzerland

[21] Appl. No.: 626,889

[22] Filed: Jul. 2, 1984

[30] Foreign Application Priority Data

Jul. 26, 1983 [CH] Switzerland ..... 4082/83

[51] Int. Cl.[4] ..... B41F 1/28; B41F 21/00

[52] U.S. Cl. ..... 101/415.1; 101/378; 101/383

[58] Field of Search ..... 101/368, 375, 378, 382 R, 101/383, 415.1, 386, 388, DIG. 12

[56] References Cited

U.S. PATENT DOCUMENTS

| | | | |
|---|---|---|---|
| 1,996,581 | 4/1935 | Lougee et al. | 101/378 |
| 2,022,681 | 12/1935 | Lougee et al. | 101/378 |
| 3,119,331 | 1/1964 | Koch et al. | 101/415.1 |
| 3,858,512 | 1/1975 | Simeth | 101/415.1 |
| 3,884,147 | 5/1975 | Abendroth | 101/415.1 |
| 4,006,686 | 2/1977 | Ackerman | 101/415.1 |
| 4,157,067 | 6/1979 | Datwyler | 101/415.1 |

FOREIGN PATENT DOCUMENTS

| | | | |
|---|---|---|---|
| 1939358 | 6/1970 | Fed. Rep. of Germany | 101/415.1 |
| 1952335 | 6/1970 | Fed. Rep. of Germany | 101/415.1 |
| 2702393 | 8/1978 | Fed. Rep. of Germany | 101/415.1 |

*Primary Examiner*—Edgar S. Burr
*Assistant Examiner*—James R. McDaniel
*Attorney, Agent, or Firm*—Kane, Dalsimer, Kane, Sullivan and Kurucz

[57] ABSTRACT

The first end of the printing plate is introduced between the jaws of a clamping device housed in an axial groove of plate cylinder and tightened by means of screws. The plate is stretched on the cylinder surface and its distal end is engaged between the jaws of a second clamping device located in the axial groove, and the jaws are tightened by means of screws. The plate is stretched by feeding hydraulic jacks set at spaced intervals along the lower jaw of the clamping device of which the pistons react against the adjacent radial face of the groove, thus moving the clamping device in the peripheral direction of the cylinder. After obtaining the desired adjustment the displaced clamping device is locked by tightening in a tightening body responsive to screws projections of the displaced clamping device in order to lock same, and the pressure in the hydraulic circuit is relieved.

2 Claims, 2 Drawing Figures

METHOD OF FIXING AND ADJUSTING A PRINTING PLATE ON A PLATE CYLINDER AND DEVICE FOR CARRYING OUT THE METHOD

FIELD OF INVENTION

The present invention relates to a method of fixing and adjusting a printing plate on a plate cylinder of a rotary printing press. ths cylinder provided on its peripheral surface with at least one axial groove within which a pair of clamping devices for fixing the two ends parallel to the cylinder axis of a printing plate disposed on the peripheral surface of the cylinder are housed, at least one of said clamping devices being movable in the groove at least in the peripheral direction of the plate cylinder, hydraulic means controlling said movement in the peripheral direction of at least one of the clamping device of the groove, as well as to a device for carrying out the method.

PRIOR ART

It is known in rotary printing presses, for instance patent No. GB-A-2,101,043, to mount the printing plate or plates to the plate cylinder by firstly inserting one of the ends of the printing plate into the jaws of a clamping device housed in an axial groove of the cylinder, closing the jaw, setting the plate onto the cylinder surface and inserting the second end into a second clamping device located either in the same groove as the first one if the plate cylinder is arranged for supporting only one plate, or in a second groove if the cylinder is arranged for supporting several printing plates. After tightening the jaws of the second clamping device, the position of the printing plate must be adjusted in order to obtain a perfect registry.

As a rule, the adjustment is performed in two steps by moving by means of a screw one of the clamping devices in the axial direction of the cylinder and by stretching the plate in the peripheral direction of the cylinder by means of screws reacting against the radial wall of the groove which is adjacent to the clamping device, permitting of moving the clamping device away from this radial wall and thus stretch the plate.

To obtain a perfect registry, it is absolutely necessary (a) to ensure a perfect adherence of the printing plate on the plate cylinder, (b) to warrant the absolute homogeneity of the force for stretching the plate throughout the plate width, (c) to check that the force exerted for stretching the plate, of which the thickness is of the order of 0.5 mm, does not exceed the deformation strength of the plate to prevent the deformation (elongation) of the plate from causing the distortion of the image engraved on the plate and of course the registry.

The above-described method and device permit as a rule of meeting requirement a but not requirements b and c. In fact, even for a skilled person, it is difficult to stretch a printing plate on the plate cylinder by exerting a completely homogeneous force throughout the plate width by controlling screws or keys disposed at spaced intervals along a clamping device. On the other hand, even if one succeeds in exerting a namely homogeneous force, this result is obtained at the expenses of a considerable loss of time and there is still a risk of overcoming the resistance of the plate to distortion.

To cope with this inconvenience it was proposed in patent No. DE-A-1,939,358 to replace the screws controlling the peripheral movement of the clamping devices in the groove with pistons responsive to a hydraulic force and fed in parallel so that the homogeneousness of the stretching force throughout the plate width is obtained, a pressure gage permitting of ascertaining that the stretching force does not exceed the deformation strength of the printing plate. With this device it is possible to meet the afore-mentioned requirements b and c, however, no means are provided for locking the clamping devices, and this may prove somewhat detrimental. During the operation of the printing press a pressure drop may occur as a consequence of a defective tightness or any other cause attended by a release of the printing plate affecting the registry and likely to cause physical damage to the machine. During the cylinder rotation the hydraulic conduits are subjected to the centrifugal force and the tightness of the various connections may become defective and cause the spraying of liquid, as a rule oil, resulting on the one hand in the release of the printing plate due to the pressure drop and on the other hand in the spraying of various parts of the printing machine with the liquid. Even with the hydraulic circuit is constructed with extreme cares, which increases the manufacturing cost of the machine, one is by no means sheltered from such mishap of which the financial consequences are considerable in relation both to the time lost as the result of the stopping of the machine and for its reconditioning and to the material damages resulting therefrom.

SUMMARY OF THE INVENTION

The present invention has for its object of avoiding these inconveniences and provides a method of fixing and adjusting a printing plate on a plate cylinder by utilizing for the adjustment the advantages offered by the hydraulic device while permitting of avoiding during the cylinder operation the inconvenienees of a leakage in the hydraulic circuit.

The method according to the invention is characterized by the fact that (a) the first end of the printing plate is introduced between the jaws of one of the clamping devices, and the jaws are tightened;

(b) the plate is stretched on the peripheral surface of the cylinder and the second end of the plate is introduced between the jaws of the second clamping device, and the jaws are tightened;

(c) the hydraulic means are fed with a liquid until a predetermined pressure is attained in order to move the clamping device or devices within the groove in the peripheral direction of the cylinder in order to stretch the printing plate and cause it to adhere to the peripheral surface of the plate cylinder;

(d) the position of the clamping device or devices displaced by said hydraulic means is locked mechanically and the pressure exerted on the liquid of the hydraulic circuit is eliminated.

The advantages deriving from the method of the invention consist essentially, as mentioned hereinabove, in utilizing the hydraulic device for stretching a printing plate, thus ensuring the uniformity of the stretching force exerted on the whole of the plate width, from the dual point of view of magnitude and time, the tension being applied simultaneously along the end of the plate clamped between the jaws of the clamping device and in the fact that after having made use of the advantaged offered by the hydraulic positioning its drawbacks are eliminated by locking the clamping device in the displaced position while releasing the pressure in the hydraulic circuit.

The invention is also concerned with a device for carrying out the method.

The device for implementing the method is characterized by the fact that the hydraulic means for displacing in the peripheral direction a clamping device within an axial groove consist of at least two hydraulic jacks housed in two casings of the clamp body, opening toward the adjacent radial wall of the groove so that the pistons of said jacks which extend at least substantially at right angles to said adjacent radial wall may bear against the latter and move the clamping device by feedback towards the centre line of the groove, that a mechanical clamping device secured in the vicinity of the median line of the groove is engageable by one portion of the adjacent side face of the clamping device so as to be clamped therein upon completion of the fixing and adjustment of the printing plate and for locking the clamping device in this position, and that a device is contemplated for relieving the pressure of the liquid in the hydraulic device subsequent to the locking of the clamping device in said position.

BRIEF DESCRIPTION OF THE DRAWINGS

The invention will now be described more in detail with reference to the accompanying drawing.

DESCRIPTION OF THE PREFERRED EMBODIMENTS

The following description relates to a plate cylinder intended for supporting a single printing plate and therefore provided with only one axial groove.

Figure 1:
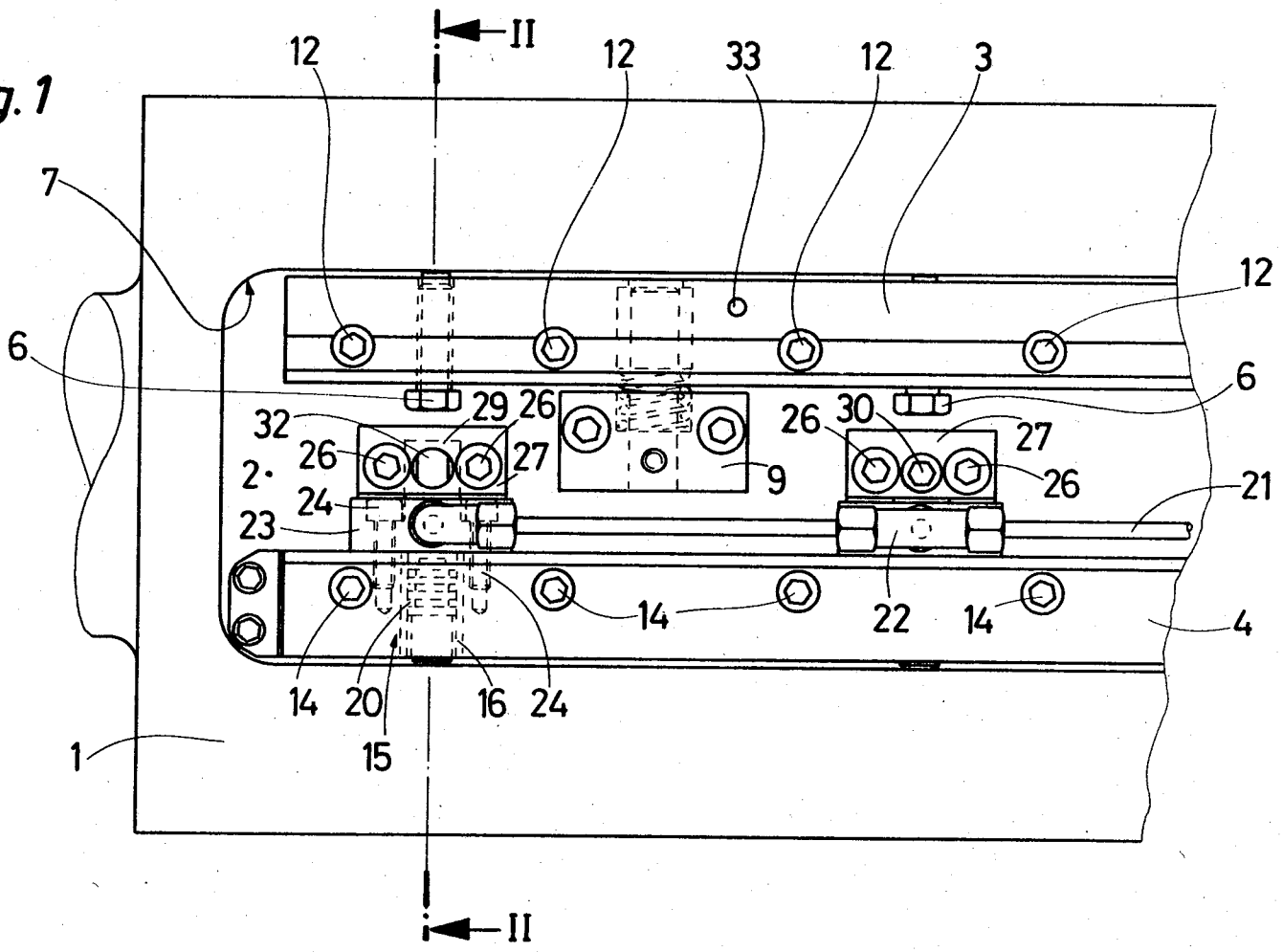
FIG. 1 is a fragmentary diagrammatic plane view of a plate cylinder showing the axial groove and the fixing and adjustment clamping devices.
Figure 2:
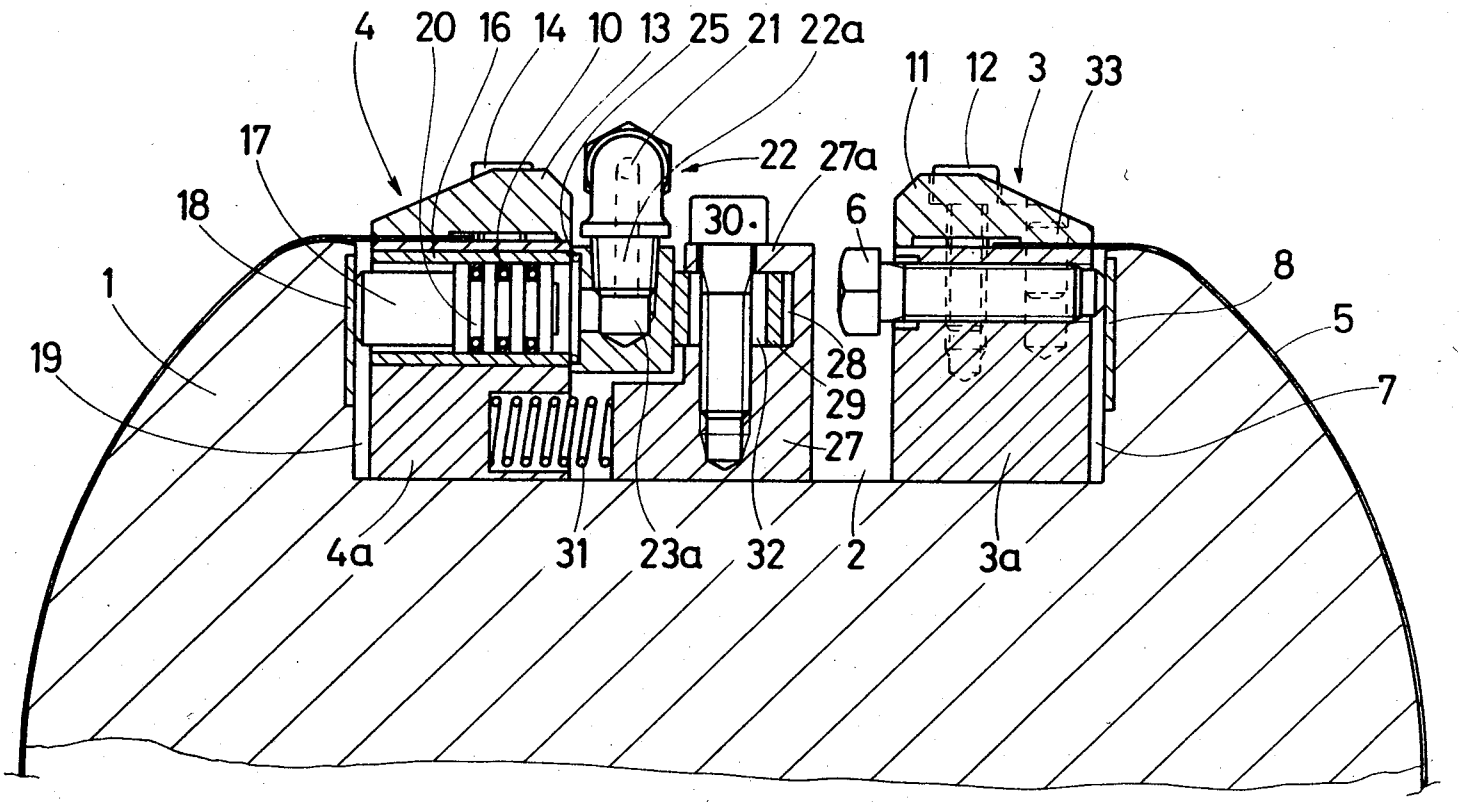
FIG. 2 is a radial section taken along the line II—II of FIG. 1.

The plate cylinder 1 is provided within the groove 2 with two clamping devices 3 and 4 for fixing the two ends of a printing plate 5. In the example illustrated in FIGS. 1 and 2 only the clamping device 4 is provided with hydraulic means for displacing this device in the peripheral direction within the groove 2. Both clamping devices 3 and 4 are mounted for movement in the peripheral direction within the groove in a known fashion. For a finer adjustment the clamping device 3 may be provided with means permitting its axial displacement. An axial adjustment of the plate may also be obtained through the axial displacement of the plate cylinder. The clamping device 3 is provided with five transverse tapped holes engageable by five bolts 6 bearing against the radial wall 7 of groove 2 adjacent to clamping device 3. When screwing the bolts 6 in the tapped holes, their ends react against an abutment surface 8 of radial wall 7 and by counteraction the clamping device 3 is shifted inwards in the groove. Two return devices 9 located in the vicinity of the centre line of groove 2 urge the clamping device 3 against the radial wall 7. The clamping device 3 consists of a body 3*a* provided with means permitting its displacement on the bottom of groove 2 and its upper face constitutes the lower jaw of clamping device 3 whereas a second detachable jaw 11 is secured thereto by means of screws 12 ensuring the tightening. The body 3*a* is provided on its upper face with two studs 33 for retaining the end of the printing plate which is provided for this purpose with two corresponding holes.

However, the clamping device 3 may consist of an entirely fixed element if one considers the possibility that the printing plate be positioned on the cylinder with the image exactly in axial alignment. In this case the plate retained by the studs 33 (which are at least two in number) will be properly positioned—as far as clamping device 3 is concerned—with respect to the cylinder. Of course, the positioning of fixed clamping device 3 and studs 33 must be made with a high degree of precision. The clamping device 4 comprises like clamping device 3 a body 4*a* topped by a detachable jaw 13 secured and tightened by screw 14. The body 4*a* of clamping device 4 is provided with five transverse cylindrical passages in which five hydraulic jacks 15 are housed. Each jack 15 consists of a cylinder 16 secured inside a cylindrical recess of body 4*a*, of a piston 17 mounted in fluid-tight relationship in cylinder 16 so that its end projects from the lateral face of clamping device 4 and bears against an abutment face 18 of the radial face 19 of groove 2, adjacent to clamping device 4. The piston head of same diameter as the inner diameter of cylinder 16 is provided with three grooves 20 in which packings 10 providing the necessary fluid-tightness between the head of piston 17 and the cylinder 16 are fitted. The hydraulic jacks 15 are fed via a conduit 21 supplied in turn from a pump, the fluid pressure being controlled by a pressure gage to prevent any overstepping of the deformation strength limit of printing plate 5. The pump and pressure gage are not shown. The conduit 21 is provided with five T unions 22 for feeding each cylinder 16. The arm 22*a* of each T union 22 which is perpendicular to conduit 21 has a frustoconical configuration and is screwed in a body 23 secured in turn by two screws 24 to the body 4*a* of clamping device 4 in front of cylinder 16. This arm 22*a* opens into a blind hole 23*a* of body 23 registering with, and forming an extension of, cylinder 16. An O-ring 25 seals the joint between the body 23 and the body 4*a* of the clamping device. In the vicinity of the center line of groove 2 an element 27 adapted to tighten by distortion is secured by screws 26 and registers with each one of said T unions 22. The tightening element 27 is provided in its upper portion with an elongated mortise 28 registering with a projection 29 of body 23. This projection 29 is a cubic block welded to the body 23 and provided with an oval-sectioned bore 32. A screw 30 extends through the upper wall of the mortise and engages the lower portion of tightening body 27. Finally, between two adjacent faces of the lower portions of the body 4*a* of the clamping device and of the tightening body, a return spring 31 is housed for urging the clamping device 4 against the radial wall 19 of groove 2.

For positioning the printing plate the following procedure is adhered to:

One end of the printing plate is introduced between the jaws of clamping device 3 and the latter is tightened by means of the screws 12. The plate 5 is stretched on the peripheral surface of the cylinder and its second end is introduced into the jaws of the clamping device 4 which is tightened by means of the screws 14. The hydraulic circuit feed pump, which may be a small manual pump, is actuated until the allowed pressure is displayed by the pressure gage. The increment in the hydraulic pressure is transmitted simultaneously to all cylinders 16 via conduit 21 and T unions 22, and urges the pistons 17 against the abutment face 18. Due to the counteraction effect, the clamping device 4 is shifted inwards of groove 2 and the printing plate 5 is stretched on the cylinder and when the hydraulic pressure attains its maximal permissible value the screws 30 are tightened and cause the upper portion 27*a* of body 27 to yield, thus locking the projection 29. Henceforth the clamping device 4 is locked mechanically in this position and it is only necessary to relieve the hydraulic pressure which is no more useful, for example by means of a bypass and to subsequently isolate the pump from the hydraulic circuit by closing for instance a valve interconnecting them.

Of course, if the cylinder is designed for supporting several plates, for example three, it is provided on its peripheral surface with three axial grooves each provided with two clamping devices. One of the clamping devices is intended for fixing one end of a printing plate of which the distal end will be fixed by one of the clamping devices of the next groove, and so forth. The above-described method and device may also be used in this embodiment for fixing and adjusting each plate.

What is claimed is:

1. A device for adjusting and fixing a printing plate with two ends, to a plate cylinder having a peripheral surface and an axial groove formed in said surface, comprising:

a pair of clamping devices with jaws disposed within said groove for securing said ends in parallel with the cylinder axis with the plate being disposed on said peripheral surface; at least one of said clamping devices being peripherally adjustable within said groove at least in the peripheral direction and having a body, at least two recesses formed in said body opening towards a radial wall of said groove and two projections extending from said body toward the centerline of the groove;

hydraulic means for tensioning one of said clamping means by displacing it peripherally away from said radial wall consisting of at least two hydraulic jacks housed in said recesses respectively, said jacks having pistons disposed and movable at substantially right angle to said radial wall to displace said clamping device away from said radial wall when activated by hydraulic pressure; and a mechanical tightening device secured to said groove in the vicinity of the center-line of the groove for securing and locking a portion of said body after said body has been displaced away from said radial body wall to fix and adjust the printing plate said mechanical device including two distortable clamping members, said two projections extending into the clamping members, and being gripped by said clamping members when said clamping members are distorted;

whereby after the mechanical tightening device has locked said portion, said hydraulic pressure on said pistons may be relieved.

2. The device of claim 6, wherein the clamping device is provided with five hydraulic jacks disposed at spaced intervals along its length and of five projections formed on the adjacent peripheral face of the clamping device also consisting of five tightening elements.

* * * * *

UNITED STATES PATENT AND TRADEMARK OFFICE

CERTIFICATE OF CORRECTION

PATENT NO. : 4,596,188

DATED : June 24, 1986

INVENTOR(S) : ANTONIO BONOMI

It is certified that error appears in the above-identified patent and that said Letters Patent is hereby corrected as shown below:

Column 1, line 27, "jaw" should be --jaws--.

Column 1, line 62, "namely" should be --nearly--.

Column 6, line 17, delete "body".

Signed and Sealed this

Twenty-first Day of October, 1986

[SEAL]

*Attest:*

DONALD J. QUIGG

*Attesting Officer*

*Commissioner of Patents and Trademarks*